United States Patent [19]

Gerlach

[11] Patent Number: 4,470,360

[45] Date of Patent: Sep. 11, 1984

[54] SEWING MACHINE

[76] Inventor: Leif Gerlach, 238 62nd St., Brooklyn, N.Y. 11220

[21] Appl. No.: 447,200

[22] Filed: Dec. 6, 1982

[51] Int. Cl.[3] ..... D05B 11/00; D05B 1/12; D05B 57/08; D05B 49/02

[52] U.S. Cl. ..... 112/117; 112/79 R; 112/95; 112/98; 112/164; 112/185; 112/241; 112/266.1

[58] Field of Search ..... 112/117, 163, 164, 185, 112/79 R, 78, 95, 98, 154, 54, 241, 262.1, 266.1

[56] References Cited

U.S. PATENT DOCUMENTS

| | | | |
|---|---|---|---|
| Re. 11,412 | 4/1894 | Gardner | 112/164 |
| 379,570 | 3/1888 | Gardner | 112/164 |
| 447,307 | 3/1891 | Gardner | 112/164 |
| 1,221,857 | 4/1917 | Hildt | 112/117 |
| 2,589,340 | 3/1952 | Chambers | 112/79 R |
| 2,595,355 | 5/1952 | Hamby | 112/79 R |
| 2,895,438 | 7/1959 | Shotsky | 112/164 |
| 3,066,624 | 12/1962 | Jeppener, Sr. et al. | 112/185 |
| 3,407,764 | 10/1968 | Rohrlick et al. | 112/164 X |

*Primary Examiner*—H. Hampton Hunter
*Attorney, Agent, or Firm*—Thomas R. Morrison

[57] ABSTRACT

A quilting machine employs bobbin holders which support bobbins each having a conical lower portion ending in a point. A plurality of hooks are driven in an eliptical path to engage and pull down a loop of thread formed by insertion of a needle through a needle plate and the partial withdrawal thereof. The hooks keep the loop open and pull it down so that it passes over the pointed lower end of the bobbin. In order to facilitate engagement of the loop over the bobbin, the bobbins are maintained in sloped fashion. A thread take-up mechanism pulls up the loop of thread with one of the strands of the loop passing behind the bobbin between the bobbin and the bobbin holder to form a lock stitch.

9 Claims, 9 Drawing Figures

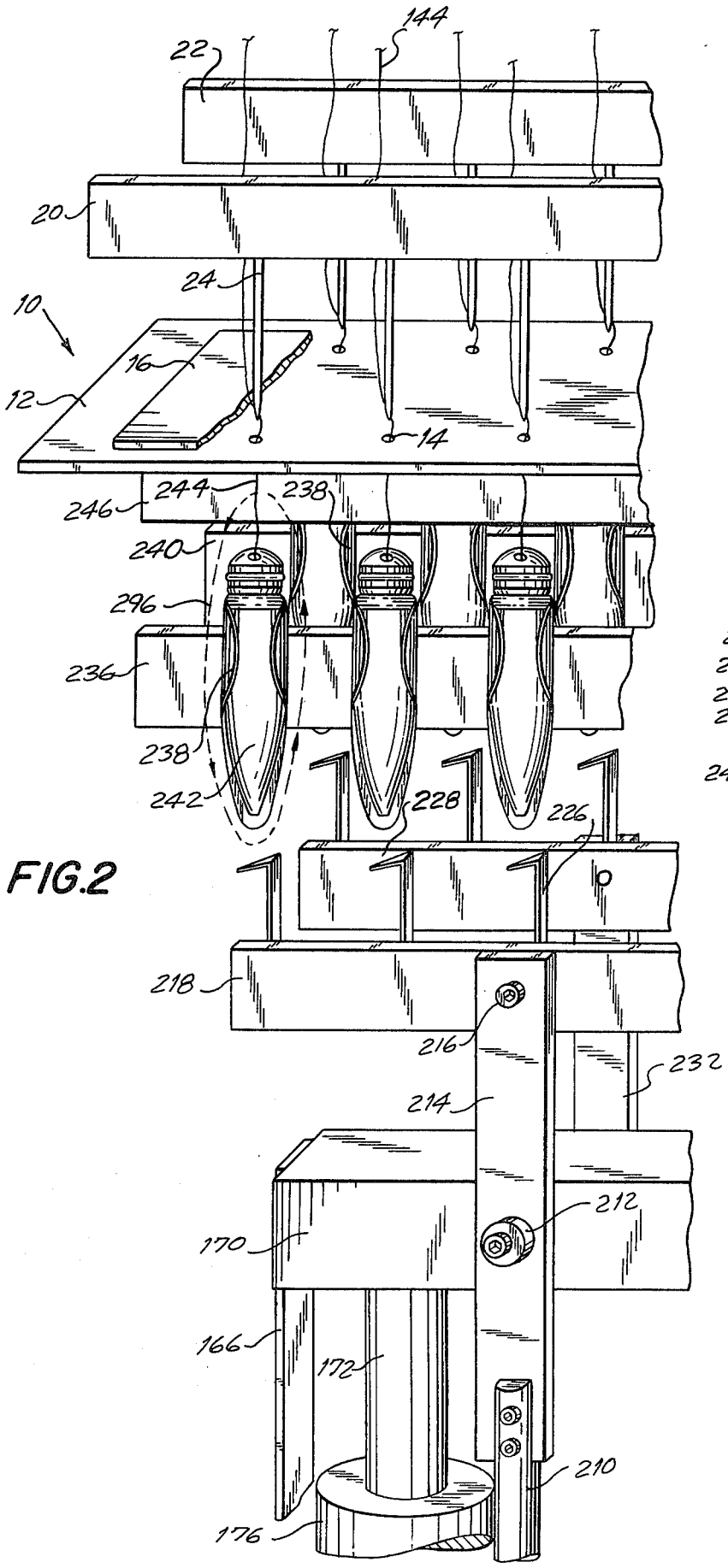
FIG.2
FIG.3
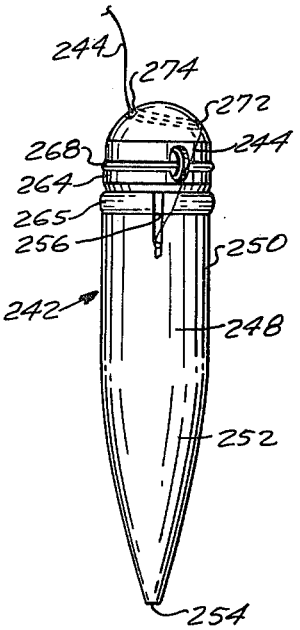

SEWING MACHINE

BACKGROUND OF THE INVENTION

The present invention relates to sewing apparatus and, more particularly, to sewing machines of the type adapted to quilting.

The first practical sewing machine was independently invented by three different inventors in the United States in the period from the mid 1830's to 1850. The basic invention consisted of a reciprocating needle having an eye near its point and a reciprocating shuttle containing a bobbin of thread. As the threaded needle passed through to the opposite side of the cloth being sewn carrying the thread with it, the shuttle passes through a loop of thread formed on the underside of the cloth to loop the thread from its bobbin about the thread from the needle. Thereupon, the needle is withdrawn and the excess thread is drawn upward through the cloth to form a lock stitch.

The above basic invention appears to have been invented about 1830 by a Walter Hunt who, concerned about the possiblity that seamstresses would be thrown out of work, suppressed the invention and never applied for a patent. Elias Howe appears to have been the next rediscoverer of the invention about 1843 and received a patent on his invention in 1846. Isaac M. Singer was the third discoverer of the basic invention and received a patent on it in 1851.

Through the remainder of the 1800's and the first half of the 1900's, the basic sewing machine remained essentially unchanged with millions of units being produced for home and factory use worldwide.

More recently, the reciprocating shuttle has been virtually replaced in conventional sewing machines by a round bobbin. The round bobbin is much superior in efficiency, reliability and cost to the conventional shuttle.

A class of sewing machine to which the round bobbin has not been applied is the class of quilting machines. Quilting machines conventionally have two or more rows of needles which are reciprocated up and down together while the fabric is moved to form decorative patterns. A conventional quilting machine has a spacing between adjacent needles in a row of about one inch and a spacing between rows of about three inches. Quilting machines have employed pairs of shuttles to service one corresponding needle in each of the rows. In a quilting machine having, for example, 100 needles in a row, 100 pairs of shuttles have been reciprocated in correct phase with the operation of the needles.

From the above description of quilting machines, one can sense the extreme crowding of apparatus below the needle plate in order to form as many as 200 stitches at the same time. Due to the large number of simultaneous operations, the added smoothness, reliability and reduced cost of round bobbins would be desirable. However, due to the restricted space available in quilting machines, the use of round bobbins has not been successfully applied. Thus, present quilting machines require a large number of parts such as, for example, 1,040 parts not counting screws in a 72" wide standard quilting machine. A significant portion of these parts are special complicated expensive castings. With so many parts operating in a typical start-and-stop fashion of reciprocating shuttles, high complexity leading to high manufacturing and maintenance cost results.

From the standpoint of production, an uninterrupted run of a quilting machine is limited largely by the capacity of the bobbins in the shuttles. If a relatively small bobbin is employed, a relatively short run time of two or three hours is possible before the bobbins in all of the shuttles must be replenished. Although it is possible to use larger bobbins in the shuttles, when this is done, the machine must be slowed down due to the increased inertia of the many larger shuttles and bobbins.

OBJECTS AND SUMMARY OF THE INVENTION

Accordingly, it is an object of the present invention to provide a sewing apparatus which overcomes the drawbacks of the prior art.

It is a further object of the invention to provide a quilting machine which reduces the number of parts and permits increasing the speed of sewing.

It is a further object of the invention to provide a quilting machine having a plurality of rows of needles which eliminates the need for a conventional shuttle attending each needle.

It is a further object of the invention to provide a quilting machine which permits the use of larger bobbins to thereby enable longer uninterrupted quilting runs.

It is a further object of the invention to provide a quilting machine that is cheaper and simpler to build and maintain but which provides increased throughput with higher reliability. In a preferred embodiment, a 76-inch quilting machine employ only about 624 parts without requiring any special castings.

According to an aspect of the present invention, there is provided a sewing machine, comprising a needle plate having at least one needle hole therein, at least one needle having an eye proximate its point, means for entering the point through the needle hole whereby a thread loop is formed below the needle plate, at least one bobbin adapted for holding a supply of thread and for feeding out the thread under a controlled tension, at least one bobbin basket adapted to freely support the bobbin, means for preventing withdrawal of the bobbin from the bobbin basket, means for drawing the thread loop over an end of the bobbin, means for disengaging the hook from the thread loop, and means for withdrawing excess thread in the thread loop whereby one of a descending strand and an ascending strand passes between the bobbin and the bobbin basket to form a lock stitch with thread from the bobbin.

According to a feature of the present invention, there is provided a method for forming a stitch, comprising forming a thread loop with a needle below a needle plate, freely supporting a bobbin containing a thread in a bobbin basket below the needle plate, engaging the loop with a hook, holding open and pulling down the loop with the hook, drawing the thread loop over an end of the bobbin, disengaging the hook, and withdrawing excess thread in the loop to form a lock stitch with thread from the bobbin.

According to a further feature of the present invention, there is provided a quilting machine, comprising a needle plate, a plurality of spaced-apart needle holes in the needle plate, a plurality of needles aligned with the needle holes, means for controlling a supply of thread to an eye proximate a point of each of the plurality of needles, means for concertedly penetrating the plurality of needles through the needle holes whereby a plurality of thread loops is formed below the needle plate, a plurality of bobbins below the needle plate, each of the bobbins being associated with one of the plurality of needles, each of the bobbins containing a supply of thread and including means for feeding the thread out at a predetermined tension, a plurality of bobbin baskets freely supporting the bobbins, the bobbin baskets surrounding at most a portion of a surface of the bobbins, an enlarged diameter portion on each of the bobbins engaging its associated bobbin basket to support the bobbin in its bobbin basket by gravity, a conical lower end ending in a point on each of the bobbins, the point being free of the bobbin basket, the bobbin baskets being disposed to position the point of each of the bobbins below its associated thread loop, a plurality of hooks, one hook associated with each of the needles, means for concertedly entering each of the hooks into the thread loop formed by its associated needle and for enlarging the thread loop and for drawing the thread loop over the point on the bobbin, means for disengaging the hooks from the thread loops, means for withdrawing excess thread in the thread loops through the needle holes, one of a descending and an ascending strand of each of the thread loops passing between its associated bobbin and bobbin basket whereby a lock stitch is formed, and means for preventing removal of the bobbins from the bobbin baskets during withdrawal of excess thread.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 2 is a closeup perspective view of a portion of the quilting machine of FIG. 1.

FIG. 3 is a side view of a bobbin used in the apparatus of FIGS. 1 and 2.

DETAILED DESCRIPTION OF THE PREFERRED EMBODIMENT

The present invention may be applicable to sewing machines employing a single needle. However, for purposes of illustration, a quilting machine is shown and described. One skilled in the art, with the instruction of the present specifcation, would readily understand the application to sewing apparatus having one or more needles in different patterns.

Figure 1:
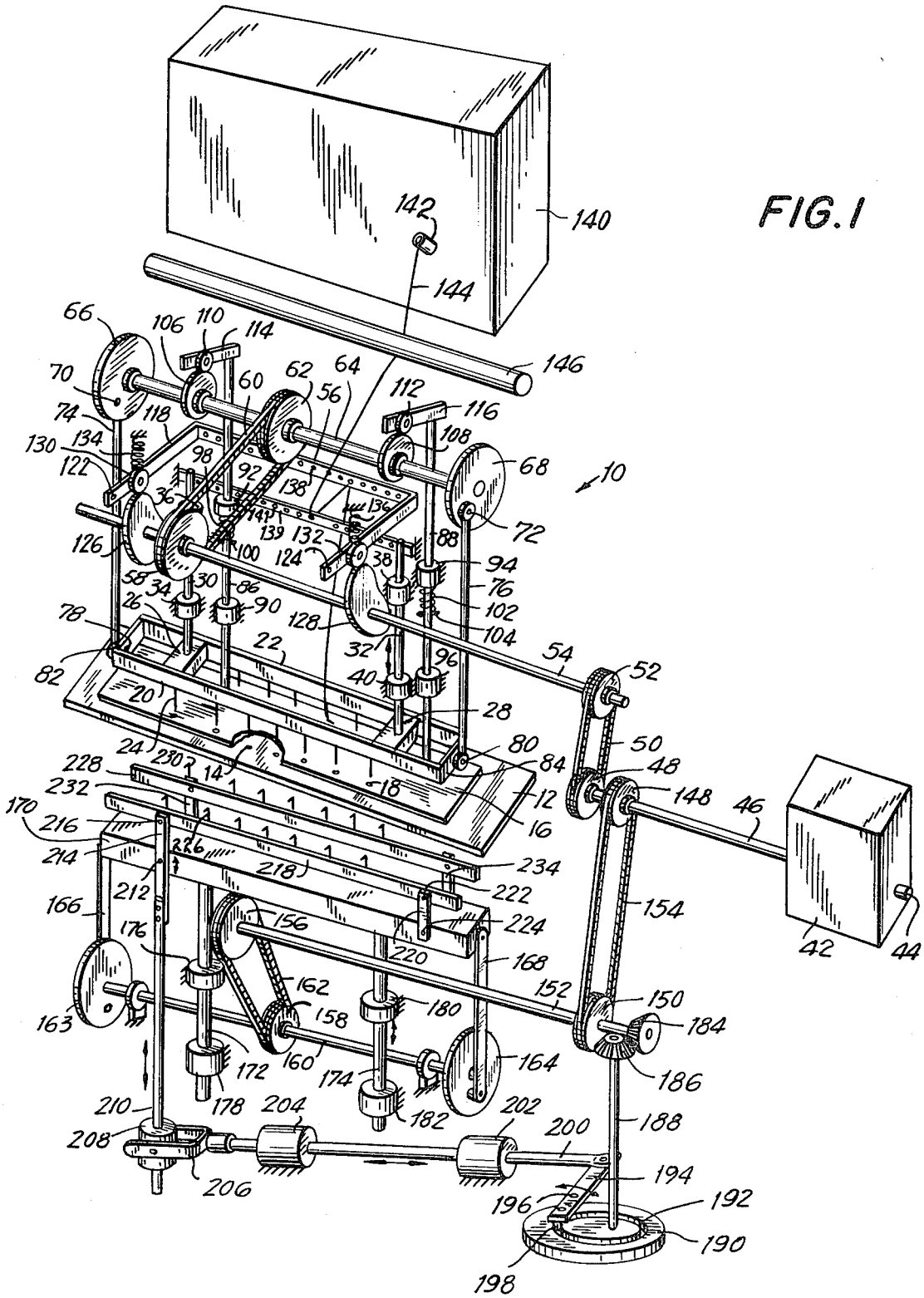
FIG. 1 is a schematic diagram of a quilting machine according to an embodiment of the invention wherein elements not necessary to the description of the function of the apparatus are omitted for clarity.

Referring now to FIG. 1, there is shown, generally at 10, a quilting machine having a needle plate 12 which includes a plurality of needle holes 14 therein. A presser foot 16 having a plurality of needle holes 18 therein aligned with needle holes 14 is arranged for up and down reciprocation as will be explained.

First and second needle bars 20 and 22 have disposed therein a plurality of needles 24 each of which is aligned with one of needle holes 18 in presser foot 16 and needle holes 14 in needle plate 12.

Needle bars 20 and 22 are maintained a fixed predetermined distance apart by a pair of bridges 26 and 28 which support vertical guide bars 30 and 32 respectively. A pair of guides 34 and 36 permit vertical reciprocation of vertical guide bar 30. Similarly, a pair of guides 38 and 40 permit vertical reciprocation of vertical guide bar 32. Thus, needle bars 20 and 22 may be moved vertically in a fashion which maintains needles 24 aligned with needle holes 14 and 18.

A reduction gear assembly 42 reduces the speed of an input shaft 44 from the typical motor speed of about 3,600 rpm to a speed on its output shaft 46 of from about 250 to about 1,000 rpm depending on the sewing speed desired or obtainable. Typically faster sewing speeds require higher horsepower from the drive motor (not shown). Quilting machines of the prior art driving 200 needles with corresponding shuttles have employed motors of about 2.5 horsepower. It is believed that the present invention, having lower inertia in its moving parts and capable of smoother operation, may be operated at the same speed as the prior art with less horsepower or may be operated at higher speeds than the prior art with the same horsepower. Although extensive use is made in the preferred embodiment of flexible timing belts and grooved pulleys, other power transmission techniques such as, for example, shafts and gears or sprockets and timing chains may be employed without departing from the spirit of the present invention.

A pulley 48, affixed to output shaft 46, drives a timing belt 50 which, in turn, drives a pulley 52 and an upper transmission shaft 54. Upper transmission shaft 54 is employed to drive the motion of presser foot 16, needle bars 20 and 22 and a thread take-up bar 56 in fixed phase relationships to form stitches.

Upper transmission shaft 54 rotates a pulley 58 which transmits power on a timing belt 60 and a pulley 62 to an upper subshaft 64. Due to the use of timing belts 50 and 60, a predetermined phase relationship is maintained between output shaft 46, upper transmission shaft 54 and upper subshaft 64. This phase relationship ensures that the several operations that are driven by these shafts are all accomplished with a predetermined phase relationship.

First and second eccentric wheels 66 and 68 include pivots 70 and 72 which are journalled to tie rods 74 and 76. A lower ends of tie rods 74 and 76 are journalled to pivots 78 and 80 which are rigidly attached to cross bars 82 and 84 of needle bars 20 and 22.

As eccentric wheels 66 and 68 are rotated by upper subshaft 64, needle bars 20 and 22, along with needles 24 are correspondingly raised and lowered.

Vertical actuating rods 86 and 88 are affixed at their lower ends to presser foot 16 and provide for time phased vertical reciprocation of presser foot 16 in order to hold the material to be sewn during entry and withdrawal of needles 24 and to release the material to be sewn between stitches so that it may be advanced. The advancing mechanism itself, being conventional, is not illustrated in order to avoid unnecessarily cluttering the drawing.

Vertical actuating rod 86 is guided in stationary guides 90 and 92. Similarly, vertical actuating rod 88 is guided in stationary guides 94 and 96. A compression spring 98 on vertical actuating rod 86 is biased between stationary guide 92 and a stop 100 which may be, for example, a pin as shown or any other device operative to receive spring force from compression spring 98. It would be clear that, as shown, spring force from compression spring 98 tends to urge vertical actuating rod 86 in the downward direction to urge presser foot 16 toward needle plate 12. Similarly, a compression spring 102 biased between guide 34 and a stop 104 tends to urge vertical actuating rod 88 and presser foot 16 in the downward direction.

A pair of cams 106 and 108 rotating with upper subshaft 64 engage cam followers 110 and 112 respectively rigidly coupled by connecting bars 114 and 116 to vertical actuating rods 86 and 88 respectively. As upper subshaft 64 performs a revolution, cams 106 and 108, rotating with it, concertedly elevate vertical actuating rods 86 and 88 and thereby elevate presser foot 16 at an appropriate point in the stitch cycle. Compression springs 98 and 102 ensure that cam followers 110 and 112 maintain contact with cams 106 and 108 and maintain spring pressure on presser foot 16 during an appropriate period in the stitch cycle.

The ends of thread take-up bar 56 are attached to levers 118 and 120 which are pivoted at their distal ends on pivots 122 and 124. A pair of kidney-shaped cams 126 and 128, rotating with upper transmission shaft 54, engage cam followers 130 and 132 pivoted on levers 118 and 120 respectively. Compression springs 134 and 136 maintain cam followers 130 and 132 in contact with cams 126 and 128.

A plurality of thread holes 138, one thread hole 138 per needle 24, are disposed along thread take-up bar 56.

A stationary thread guide bar 139 having a plurality of thread holes 141, one thread hole per needle 24, is disposed below thread take-up bar 56.

A thread creel 140, which is conventional and thus not shown in detail, contains a plurality of spools of thread, represented by spool 142, with one spool being provided for each needle 24. Thread 144 paid out from spool 142 passes through a thread tensioner 146 which may be, for example, a conventional spring-loaded plate-type tensioner, and thence through a thread hole 141 in thread guide bar 139, through a thread hole 138 in thread takeup bar 56 and then through the eye of a needle 24.

A pulley 148 on output shaft 46 is coupled to a pulley 150 on a lower transmission shaft 152 by a timing belt 154. A pulley 156 is coupled to a pulley 158 on a lower subshaft 160 by a timing belt 162.

Eccentric wheels 163 and 164 are journalled to tie rods 166 and 168 whose distal ends are pivoted to a hook base 170. Guide rods 172 and 174, affixed to the underside of hook base 170, are constrained to vertical motion by guides 176, 178, 180 and 182. Thus, as lower subshaft 160 rotates, hook base 170 is concertedly raised and lowered in phase with the remainder of the operating elements of quilting machine 10.

A bevel gear 184 on lower transmission shaft 152 meshes with and drives a bevel gear 186 which, in turn, rotates a shaft 188 and a cam plate 190. Cam plate 190 includes a cam groove 192.

A lever 194 is pivoted at a pivot 196 and includes a cam follower 198 engaged in cam groove 192. As cam plate 190 rotates, lever 194 is rotated about pivot 196 according to the shape of cam groove 192. The distal end of lever 194 is pivoted to an end of an actuating rod 200 which is constrained to linear fore and aft motion by guides 202 and 204. A yoke 206 on actuating rod 200 embraces, and is pivoted to, a guide 208 which encircles a tilt bar 210 which is, in turn, pivoted at a pivot 212 to hook base 170. An upward-extending portion 214 of tilt bar 210 is pivoted at a pivot 216 to a hook bar 218. A tilt arm 220 is pivoted at an upper pivot 222 to bar 218 and at a lower pivot 224 to hook base 170. The lengths of upward-extending portion 214 and tilt arm 220 are equal so that hook bar 218 always remains parallel to hook base 170. A plurality of hooks 226, equal in number to the number of needles 24 on needle bar 20 are disposed on hook bar 218.

A second hook bar 228 including hooks 230 equal in number to needles 24 on needle bar 22 is supported on tilt arms 232 and 234.

A rigid connection between tilt bar 210 and a lower pivot (not shown) on tilt arm 232 and/or a rigid connection between lower pivot 224 on tilt arm 220 and a corresponding pivot (not shown) at the bottom of tilt arm 234 maintains hook bars 218 and 228 concertedly parallel and at the same height. One method of maintaining parallelism employs a shaft (not shown) passing through hook base 170 and welded to tilt bar 210 at pivot 212 as well as to the corresponding lower pivot (not shown) on tilt arm 232.

From the preceding description, it will be clear that hook bars 218 and 228 are concertedly raised and lowered with hook base 170 at the same time that they are moved from side to side by tilt bar 210. The vertical and horizontal motions are sized and phased with respect to other motions in quilting machine 10 to produce a lock stitch.

Referring now to FIG. 2, a different perspective is shown to reveal elements below needle plate 12. A front bobbin bar 236 supports a plurality of bobbin baskets 238 with one bobbin basket 238 being associated with each needle hole 14 in needle plate 12. Similarly, a rear bobbin bar 240 supports a plurality of bobbin baskets 238, one for each needle hole 14 in the rear row. A bobbin 242 rests loosely in each bobbin basket with a thread 244 being withdrawn therefrom during the sewing operation as will be explained. A bobbin hold-down plate 246 is disposed a short distance above bobbins 242 to prevent bobbins 242 from being pulled completely out of bobbin baskets 238 during operation. A similar bobbin hold-down plate (not shown) is associated with bobbins 242 in the rear row.

Figure 4:
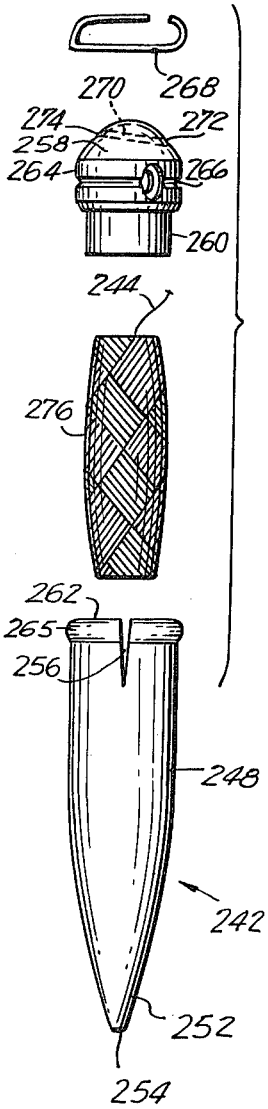
FIG. 4 is a view of the bobbin of FIG. 3 opened for further description.

Referring now to FIGS. 3 and 4, bobbins 242 are each seen to consist of a lower body 248 which is preferably of smooth metal or plastic and most preferably of aluminum or Teflon. Lower body 248 includes a cylindrical upper portion 250 and a gradually tapering conical portion 252 which smoothly joins upper portion 250 and ends in a point 254. A slit 256 at the top of upper portion 250 provides for exit of thread 244. A diagonally expanded transition portion 265 is increased in diameter compared to cylindrical upper portion 250. Expanded transition portion 265 bears against the upper rim of its bobbin basket 238 to hold bobbin 242 in its operational position.

A cap 258 includes a lower cylindrical portion 260 which is sized for a press fit into a top opening 262 in lower body 248. A central portion 264, having a diameter smaller than the maximum diameter of transition portion 265, abuts cylindrical portion 260. An annular groove 266 in central portion 264 receives a loosely fitted C-shaped loop of wire 268. A slanted hole 270 terminates at a lower opening 272 and an upper opening 274.

A skein of thread 276, fittable into the interior of lower body 248, provides the supply of thread 244.

Referring again to FIG. 3, it will be noted that thread 244 emerges from slit 256, passes under loop 268 in annular groove 266, enters lower opening 272 and exits upper opening 274. This path applies a controlled friction to thread 244 which permits only the required amount to be withdrawn from bobbin 242 as sewing proceeds. The friction is preferably sufficient to permit supporting the weight of bobbin 242 on thread 244 but light enough to permit additional thread 244 to be withdrawn upon the application of slightly more tension. Other thread friction devices are equally within the scope of the invention.

Figure 5:
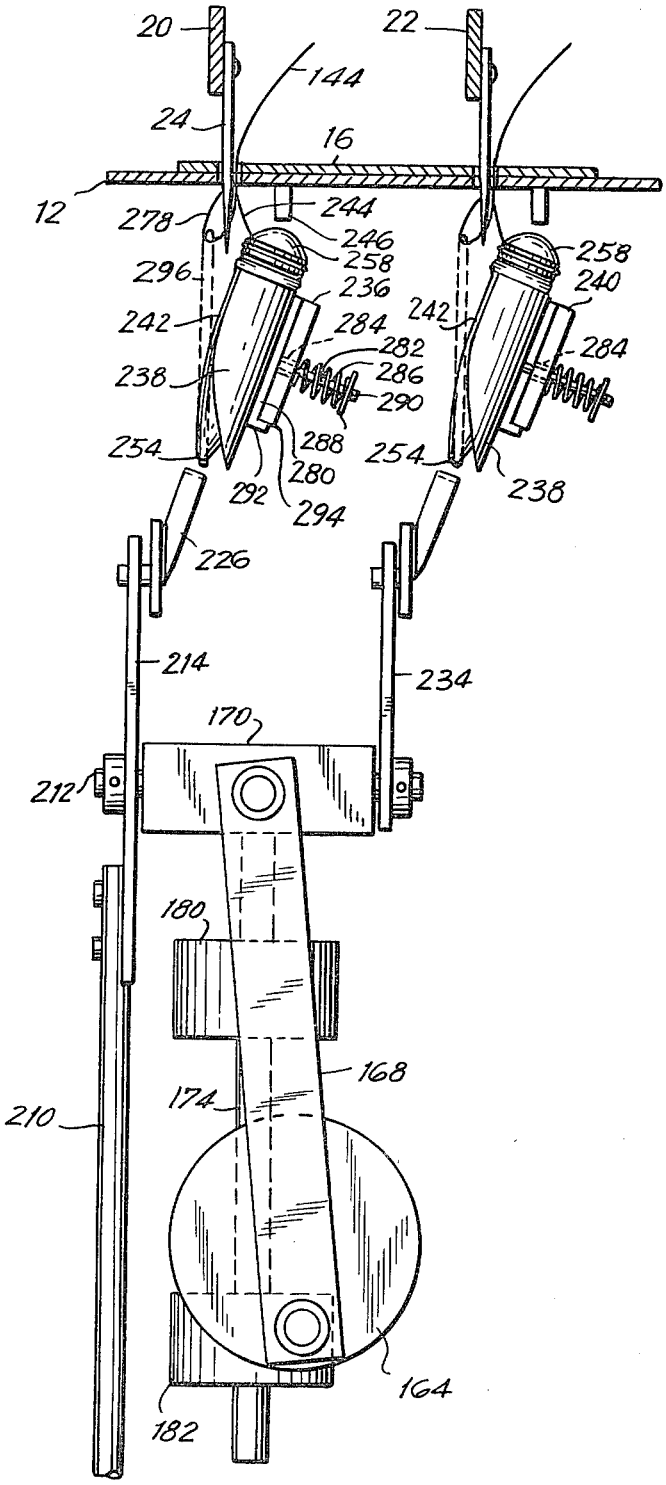
FIG. 5 is a side view of a quilting machine according to the present invention.

Referring now to FIG. 5, a side view of the apparatus is shown slightly out of phase for purposes of illustration. That is, needles 24 are shown just after they have been withdrawn slightly following their maximum penetration. Normally at this time, hooks 226 would be near the top of their travel preparatory to engagement with a loop 278 of thread 144 existing at this time. Instead, for purposes of illustration, FIG. 5 shows hooks 226 at their lower positions.

It will be noted that front and rear bobbin bars 236 and 240 are tilted so that points 254 of bobbins 242 are disposed forward of a vertical projection of needles 24. A stirrup 280 attached to each bobbin basket 238 has a rod 282 affixed thereto passing through a hole 284 in bobbin bar 236 or 240. A spring 286 on rod 282 is biased between front or rear bobbin bar 236 or 240 and a stop member such as a washer 288 and a pin 290. A lip 292 at the lower end of stirrup 280 passes over the bottom edge 294 of front bobbin bar 236. Lip 292 maintains bobbin basket 238 in its proper rotational orientation. With bobbin basket 238 in its operational position as shown, bobbin hold-down plate 246 prevents bobbin 242 from being withdrawn from bobbin basket 238. In order to change thread in bobbin 242, bobbin basket 238 is moved forward by compressing spring 286.

Other ways of freeing bobbin 242 from its entrapment by bobbin hold-down plate 246 would be clear to one skilled in the art. For example, bobbin hold-down plate 246 may be hinged, preferably spring loaded so that it can be swung away out of interference with removal of bobbin 242. Alternatively, a hinge may be provided on stirrup 280 to permit bobbin basket 238 to be tilted forward.

The path of hook 226 is represented by a dashed line 296. It will be noted that path 296 is an oval which, at its upper extremity, passes through loop 278 and at its lower extremity passes under point 254. Referring momentarily to FIG. 2, it will be seen that path 296 fairly closely follows the perimeter of bobbin basket 238 so that hooks 226 can operate in conjunction with their own bobbin baskets 238 without interference from adjacent elements.

Referring now to FIGS. 6–9, the sequence of the sewing operation is shown for a pair of adjacent bobbins 242 in highly schematized fashion. In order to avoid clutter in the drawing, extraneous elements have been omitted including cloth being sewn, presser foot 16 and the actuating elements.

Figure 7:
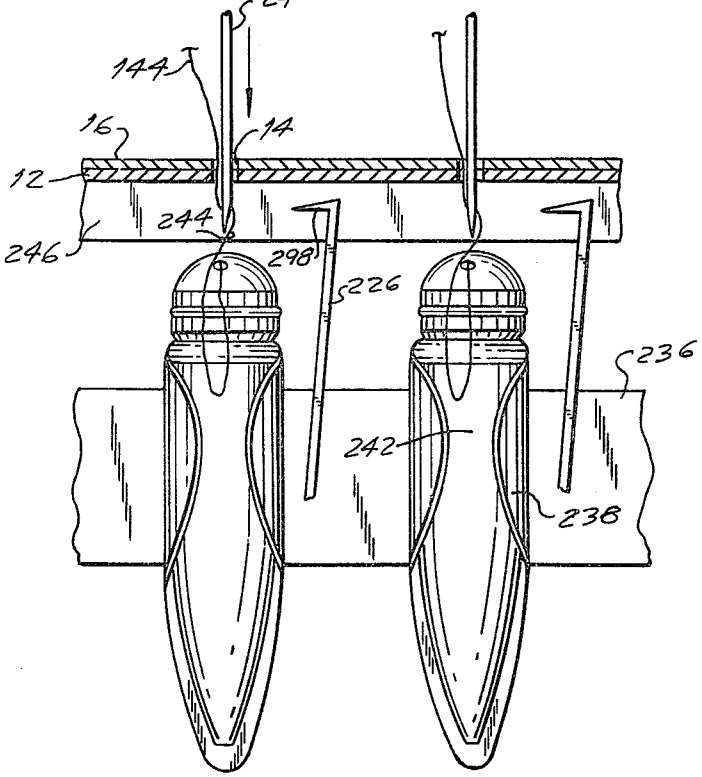
FIGS. 6–9 are schematic diagrams to which reference will be made in explaining the operation of the apparatus of the present invention.
Figure 6:
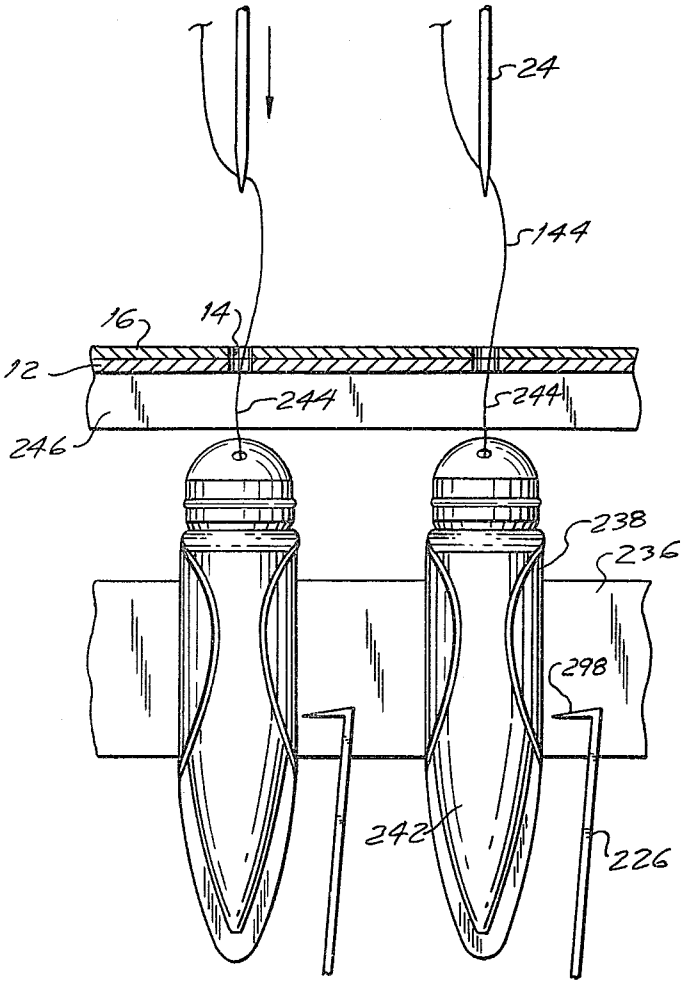
Figure 8:
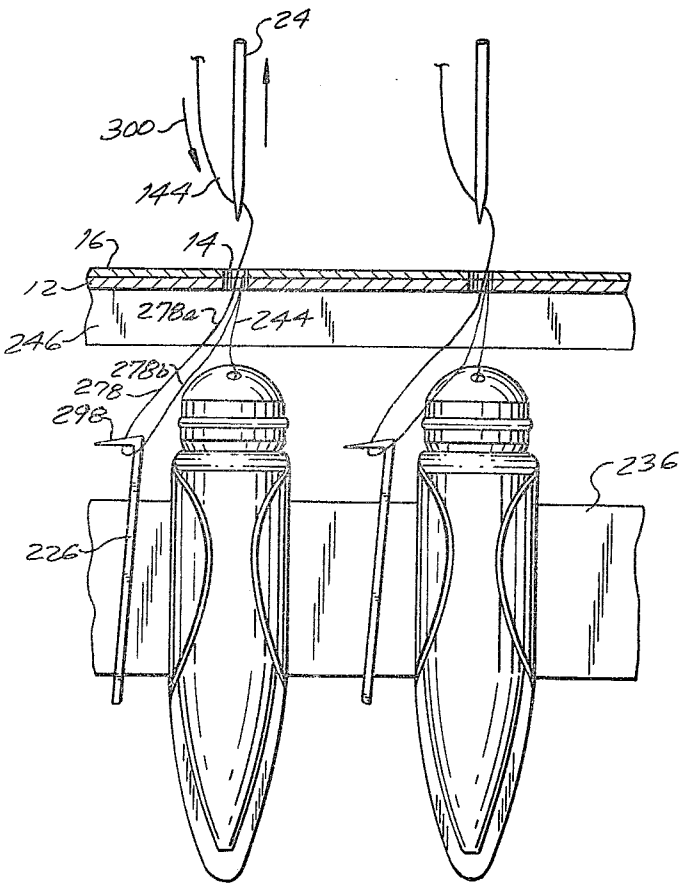

In FIG. 6, needles 24 are descending and hooks 226 are ascending. In FIG. 7, needles 24 have reached their lowest point deeply penetrating needle holes 14 and inserting thread 144 well below needle plate 12. Hooks 226 are near the top of their trajectory and closely adjacent to needles 24. Just after the positions shown in FIG. 7, needles 24 begin to withdraw, however, a loop of thread is formed below needle plate 12 just as a hook portion 298 arrives to enter it. Hook portion 298 thereupon engages the loop and, as shown in FIG. 8, begins enlarging loop 278 by pulling thread 144 through needle 24 as indicated by an arrow 300.

For purposes of description, loop 278 consists of a descending strand 278*a* from needle 24 and an ascending strand 278*b* from hook portion 298 to needle hole 14. Hook portion 298 has a sufficient dimension in a plane at right angles to the page to keep a bottom of loop 278 relatively wide open.

Figure 9:
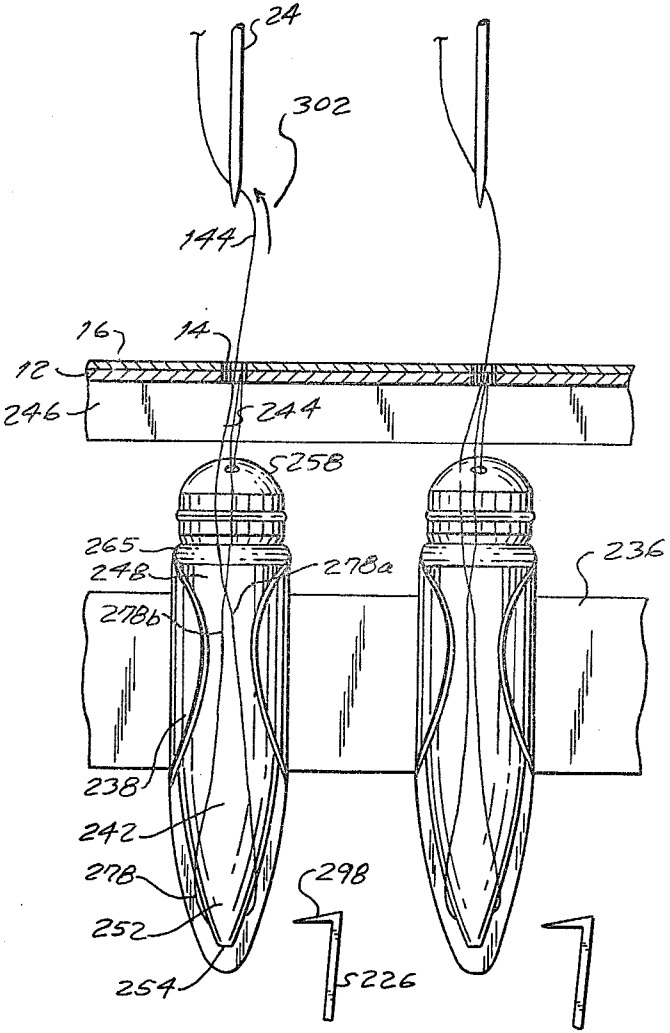

Referring now to FIG. 9, as hook 226 passes beyond point 254 of bobbin 242, descending strand 278*a* remains in front of conical portion 252 whereas ascending strand 278*b* passes behind point 254. Loop 278 disengages from hook portion 298 and hook 226 continues on its trajectory preparatory to a next cycle. At this time, thread take-up bar 56 is actuated to withdraw excess thread 144 as indicated by an arrow 302. This process continues and loop 278 is drawn up behind bobbin 242 due to the loose fit of bobbin 242 in bobbin basket 238. Loop 278 is finally pulled completely out of bobbin basket 238 past bobbin 242. The movement of thread 144 past cap 258 is aided by the smooth transition provided by diagonally expanding transition portion 265 at the upper end of lower body 248. When all of the excess thread 144 in loop 278 is withdrawn through needle hole 14, a loop is formed around thread 244 from bobbin 242 as is required to produce a lock stitch.

The present invention should be considered equally applicable to single needle sewing machines, quilting machines having a single row of needles, quilting machines having two or more rows of needles and any variations thereon.

The present invention is also applicable to trapunto quilting wherein sets of closely spaced twin needles are employed with the loops formed by each of the needles of a twin being pulled down and looped in the same fashion as the single loop previously described.

Although the present invention shows all bobbin baskets 238 in a row attached to a single bobbin bar 236 or 240, this should not be considered to limit the invention. For example, each bobbin basket 238 may be separately removably attached below needle plate 12 so that the thread in the associated bobbin 142 may be replaced without disturbing any other bobbin 142. Alternatively, pairs of corresponding bobbin baskets 238 in the front and rear rows may be attached to a removable clip-in bar (not shown) or other structure so that the pair may be removed together for thread replenishment or maintenance without disturbing adjacent bobbins 142.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A sewing machine, comprising:

a needle plate having at least one needle hole therein;

at least one needle having an eye proximate its point;

means for entering said point through said needle hole whereby a thread loop is formed below said needle plate;

at least one bobbin adapted for holding a supply of thread and for feeding out said thread under a controlled tension;

at least one stationary bobbin basket adapted to freely gravity support said bobbin;

means for preventing withdrawal of said bobbin from said bobbin basket;

hook means for drawing said thread loop over an end of said bobbin;

means for disengaging said hook means from said thread loop;

means for withdrawing excess thread in said thread loop whereby one of a descending strand and an ascending strand passes between said bobbin and said bobbin basket to form a lock stitch with thread from said bobbin; and said means for preventing withdrawal of said bobbin including means for permitting said bobbin to be displaced in said bobbin basket by said thread sufficiently to allow said excess thread to pass between said bobbin and said bobbin basket.

2. A sewing machine according to claim 1, wherein said bobbin includes a generally cylindrical portion and a continguously generally conical portion ending in a point, said bobbin basket being effective to support said bobbin with said point protruding from said bobbin basket, said means for drawing said thread loop being effective to draw said thread loop over said point.

3. A sewing machine according to claim 2, wherein said bobbin basket is effective to support said bobbin with an axis of said bobbin disposed in a diagonal direction and with said point disposed generally below an initial loop formed by said needle.

4. A sewing machine according to claim 2, wherein said means for drawing includes at least one hook, means for moving said hook in a path, said path entering said hook into said loop, said hook being effective to hold said loop open, said path moving said hook with the held-open loop so that the held-open loop passes over said point on said conical portion, said path disengaging said hook from said loop to permit operation of said means for withdrawing.

5. A sewing machine according to claim 2, wherein said bobbin basket includes portions partially encircling said cylindrical portion, said bobbin including an enlarged portion, said enlarged portion engaging with said bobbin basket to support said bobbin in said bobbin basket.

6. A sewing machine according to claim 1, wherein said means for preventing withdrawal includes a bar spaced from said bobbin, said bar preventing withdrawal of said bobbin more than a predetermined amount from said bobbin basket.

7. A sewing machine according to claim 1, wherein said sewing machine is a quilting machine operative to simultaneously form a plurality of lock stitches.

8. A method for forming a stitch, comprising:

forming a thread loop with a needle below a needle plate;

freely gravity supporting a bobbin containing a thread in a stationary bobbin basket below said needle plate;

engaging said loop with a hook;

holding open and pulling down said loop with said hook;

drawing said thread loop over an end of said bobbin;

disengaging said hook;

withdrawing excess thread in said loop to form a lock stitch with thread from said bobbin; and permitting said bobbin to be displaced in said bobbin basket by said thread sufficiently to allow said excess thread to pass between said bobbin and said bobbin basket.

9. A quilting machine, comprising:

a needle plate;

a plurality of spaced-apart needle holes in said needle plate;

a plurality of needles aligned with said needle holes;

means for controlling a supply of thread to an eye proximate a point of each of said plurality of needles;

means for concertedly penetrating said plurality of needles through said needle holes whereby a plurality of thread loops is formed below said needle plate;

a plurality of bobbins below said needl plate, each of said bobbins being associated with one of said plurality of needles;

each of said bobbins containing a supply of thread and including means for feeding said thread out at a predetermined tension;

a plurality of stationary bobbin baskets freely supporting said bobbins, said bobbin baskets surrounding at most a portion of a surface of said bobbins;

an enlarged diameter portion on each of said bobbins engaging its associated bobbin basket to support said bobbin in its bobbin basket by gravity;

a conical lower end ending in a point on each of said bobbins, said point being free of said bobbin basket;

said bobbin baskets being disposed to position said point of each of said bobbins below its associated thread loop;

a plurality of hooks, one hook associated with each of said needles;

means for concertedly entering each of said hooks into the thread loop formed by its associated needle and for enlarging said thread loop and for drawing said thread loop over said point on said bobbin;

means for disengaging said hooks from said thread loops;

means for withdrawing excess thread in said thread loops through said needle holes, one of a descending and an ascending strand of each of said thread loops passing between its associated bobbin and bobbin basket whereby a lock stitch is formed;

means for preventing removal of said bobbins from said bobbin baskets during withdrawal of excess thread; and said means for preventing removal including means for permitting said bobbin to be displaced in said bobbin basket by said thread sufficiently to allow said excess thread to pass between said bobbin and said bobbin basket.

* * * * *